United States Patent [19]

Veenema

[11] 3,989,157

[45] Nov. 2, 1976

[54] CONTAINER ASSEMBLY

[75] Inventor: James Veenema, Centerport, N.Y.

[73] Assignee: Lunn Laminates, Inc., Wyandanch, N.Y.

[22] Filed: May 29, 1974

[21] Appl. No.: 474,258

[52] U.S. Cl. ..... 220/4 F; 217/12 R; 217/65; 217/69; 220/73; 220/80; 220/84

[51] Int. Cl.[2] ..... B65D 7/32; B65D 9/34; B65D 7/44

[58] Field of Search ..... 220/4 D, 4 F, 73, 80, 220/83, 84; 217/12 R, 12 A, 65, 69

[56] References Cited

UNITED STATES PATENTS

| | | | |
|---|---|---|---|
| 2,578,644 | 11/1951 | Mautner | 217/65 |
| 2,775,361 | 12/1956 | Kasdan | 217/69 |
| 3,088,623 | 5/1963 | Parker | 220/73 |
| 3,156,370 | 11/1964 | Monfort | 217/65 |
| 3,261,493 | 7/1966 | Smith | 217/65 |
| 3,288,319 | 11/1966 | Cahill | 217/65 |
| 3,561,633 | 2/1971 | Morrison | 220/84 |
| 3,724,701 | 4/1973 | Barkow | 217/65 |

*Primary Examiner*—George E. Lowrance
*Attorney, Agent, or Firm*—Edward H. Loveman

[57] ABSTRACT

An assembly for a container having a plurality of panels each of which is engaged at marginal edges thereof by a channel shaped rail. Moldings formed with pairs of spaced parallel flanges define recesses for receiving the rails.

10 Claims, 5 Drawing Figures

48
52
40
44
60
46
38
56
57
30a
68
70
64
66
42
59
58
54
72
72
62
62
50
66
60
64
70
22
92
18
24
22
26
14
91
64'
70'
60'
62'
78
34b
84a
84
20
66'
86
82
76
80
89
75
34a
88
90

CONTAINER ASSEMBLY

This invention relates to a panel assembly for forming a container for a transportation vehicle and more particularly concerns an assemblage of panels, moldings and rails adapted to secure the panels in mutually perpendicular planes without the use of supplementary fastening devices such as bolts or rivets.

Heretofore, it has been conventional to assemble panels to form a container body by setting edges of each panel in grooves formed in adjacent panels, and then gluing them together. This method has many objections since it requires skilled workmanship, special jigs, and large clamps and frames to hold the parts in place during gluing. A far more significant disadvantage of this method is that the glue deteriorates with time so that the panels separate. Other disadvantages of this method are that the joint cannot stand repeated stresses and strains, and crack under them and that this method does not work well with thin wood panels.

In order to solve some of these problems, panels have been joined by employing perimeter rails. Holes are drilled at spaced points near edges of the panels to register with holes in the rails. Then the panels are secured in place by bolts and nuts or rivets or other fastening devices. While this method is common and conventional in manufacturing container bodies in the transportation industry, it leads to other difficulties. The stresses and strains to which the panels are subjected during use, are focused at points where the panels are weakest, i.e., at the marginal edges where the fasteners extend through the panels. The panel localized failure occur because of elongation, sheer tension, corrosion, and accidental removal of the fastener. Another objection is the projection of the fastener into the interior of the assemblage which should be left clear for storing of cargo. A further objection is the high cost of labor and the machinery required to assemble a container body by use of the fasteners.

The present invention is directed at overcoming the above and other difficulties and disadvantages of prior container bodies formed of joined panels, by providing specially extruded rails adapted to hold edges of panels securely and permanently, without use of supplementary fastening devices.

According to the invention, perimeter rails are provided, with each rail having spaced flanges formed with internal opposing ledges which engage on edges of U-shaped moldings. The molding is permanently mounted on edges of the panels. The edges of the panels are secured for their entire length so that all joints extend for the full length of the assemblage. The moldings have internal grooving or knurling and internal ribs or ridges which bite into the body of the panels to remain securely in place. By the arrangement described, a container body for a truck or trailer, etc. may be quickly and easily assembled by workers with no special skill or special tools. The joints are permanent and hold the panels securely. There are no projections into the interior of the boxlike container body. The rails and moldings are actually stronger than the panels themselves so that any strain which the panels themselves can stand can also be bourne by the joints. The container body is thus assembled quicker and at lower cost than prior units and it has a longer useful life.

These and other objects and many of the attendant advantages of this invention will be readily appreciated as the same becomes better understood by reference to the following detailed description when considered in connection with the accompanying drawings in which.

Figure 1:
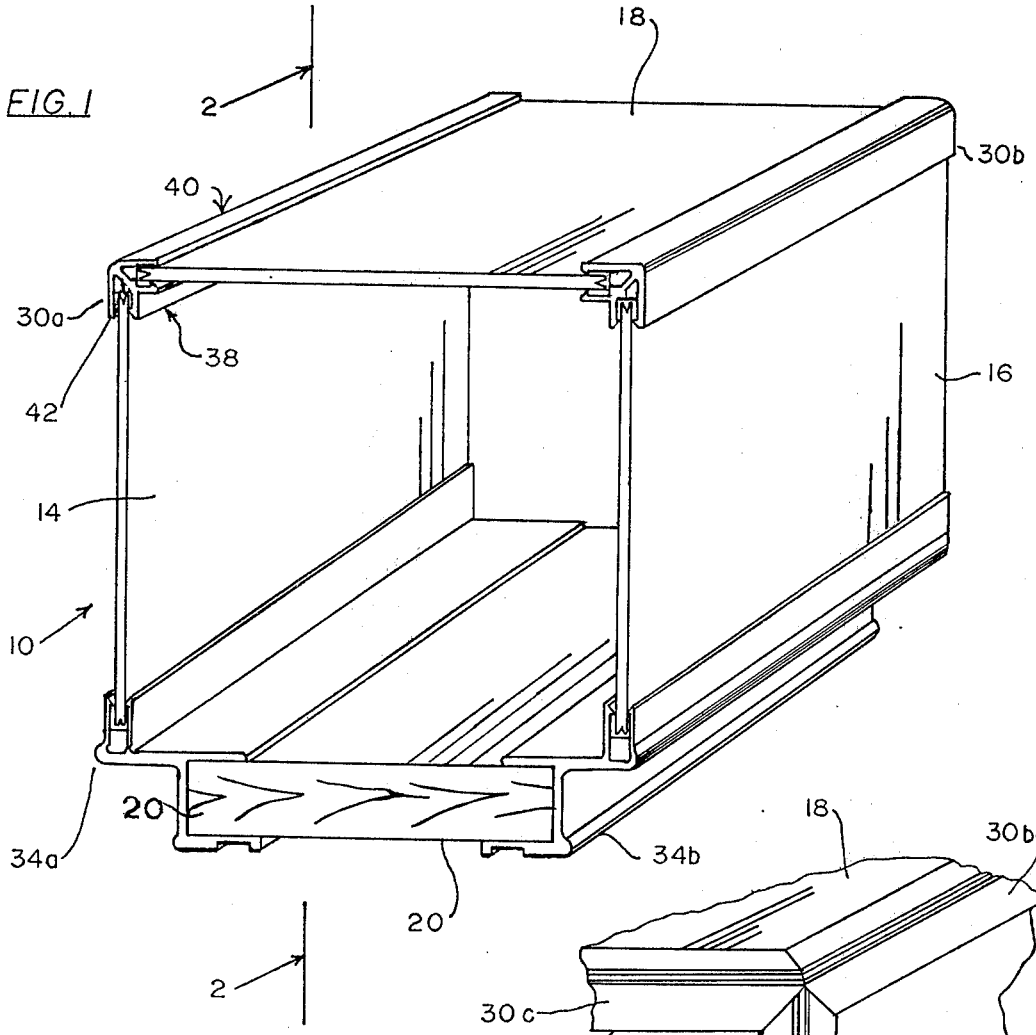
FIG. 1 is a perspective view of a container body including a panel assembly embodying my invention with the front panel assembly removed.
Figure 2:
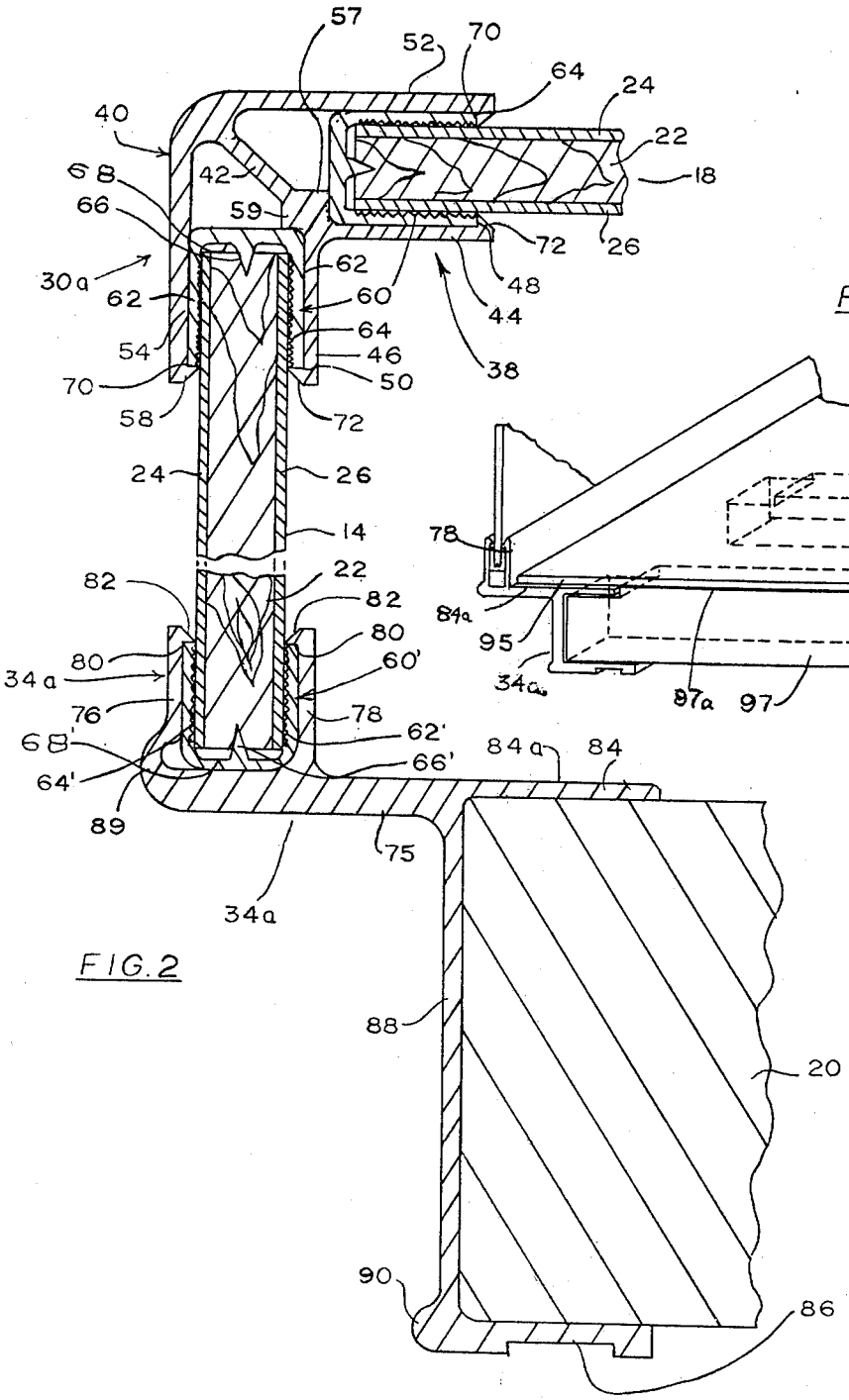
FIG. 2 is an enlarged fragmentary vertical section view taken along line 2—2 of FIG. 1.
Figure 3:
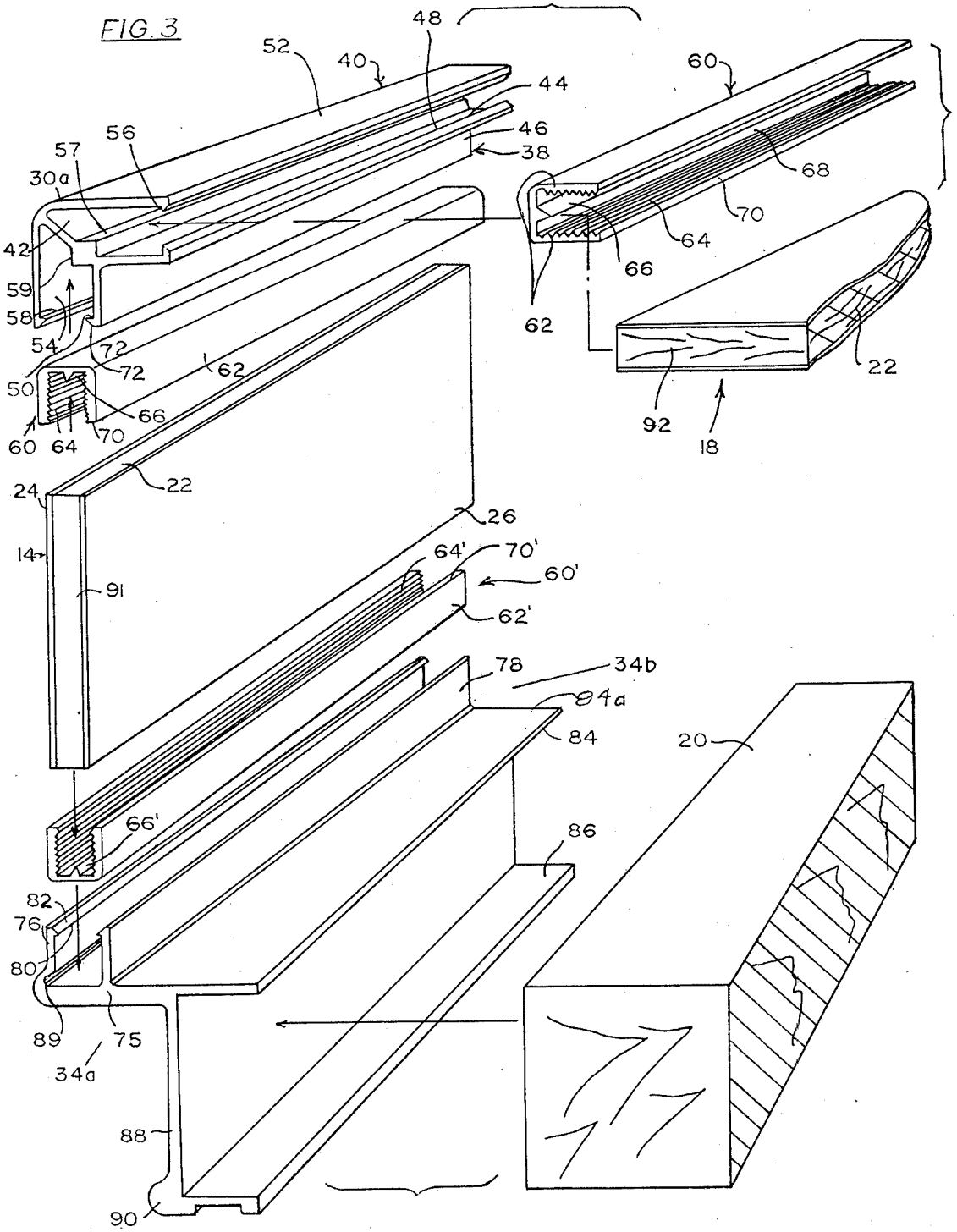
FIG. 3 is an exploded perspective view of the parts of the panel assembly.

Referring now to the drawings wherein like reference characters designate like or corresponding parts throughout, there is illustrated in FIGS. 1–3, a container body generally designated as numeral 10 which has vertical side panels 14, 16 a horizontal top panel 18 and a floor 20 with the end panels being omitted for clarity and understanding of the invention. The top and side panels may be made of laminated plywood, about one inch thick, with each having an internal core 22 and smoothly finished external laminations 24, 26 (see FIGS. 2 and 3). The floor 20 is more massive than the top panel 8 and the side panels 14, 16 and may be about four inches thick.

The panels and floor are joined by a unique assembly of extruded rails. There are two top rails 30*a*, 30*b*, which are identical in construction, and two lower rails 34*a*, 34*b*, which are also identical in construction as best illustrated in FIGS. 2 and 3.

Each of the top rails 30*a* and 30*b* includes an inner right angle rail generally designated by reference numeral 38 and an outer right angle rail generally designated as reference numeral 40 which are joined by an integral web 42 extending the full length of the rails 38, 40. Each of a pair of flanges 44, 46 of the inner rail 38 is formed at its respective edge with a respective ledge 48, 50 extending outwardly. In an identical fashion each of a pair of flanges 52, 54 of the outer rail 40 is formed at its respective edge with a respective ledge 56, 58 extending inwardly toward the ledges 48, 50. At the inner side of each of the flanges 52, 54 are respective ridges 57, 59 extending the full length of the respective rails 38 and 40. On opposite edges of each of the panels 14, 16 and 18 is a channel shaped molding generally designated as reference numeral 60 which is U-shaped in cross section. Each of the moldings 60 has a pair of side walls 62 formed in internal longitudinal extending grooving or knurling 64 defining teeth when viewed in cross section. These teeth grip the sides of the respective panel which is snugly inserted into each molding 60. If desired a conventional adhesive may be provided between a panel and a molding 60. A ridge 66 with a rather sharp edge is formed at the inner side of an end wall 68, of each of the moldings 60. The ridge 66 penetrates the respective panel core 22 and cooperates with the grooved inner sides of the walls 62 to hold the molding 60 securely on the end of the respective panel. Each molding 60 fits snugly into one of rails 30*a* or 30*b*. The ledges 48, 50 lock underneath or behind a free edge 70 on the side wall 62. The ledges 48, 50 have inwardly beveled edges 72 to facilitate insertion of the moldings 60 into a respective rail 30*a* or 30*b*. The respective ledges 48, 50 snap in place and thereafter hold the moldings 60 securely without the use of bolts or any other fastening devices.

The bottom rails 34*a*, 34*b* are each formed with a thick horizontal flange 75. A pair of inner and outer flat flanges 76, 78 extend vertically upward and are respectively formed with an inner ledge 80, with a beveled edge 82. The flanges 76 and 78 receive a lowermost molding 60′ secured to the bottom edge of each of the vertical panels 14, 16. The ledges 80 engage the upper free edges 70′ of the moldings 60′ (FIG. 3). A sharp edged inner ridge 66′ inside each of the rail 60′ extends into the bottom end of the respective core 22 of the panels 14, 16 while the grooved inner sides of the walls 62′ grip the opposite sides of the vertical panels.

Opposite lateral ends of the massive floor 20 fit snugly between a pair of horizontal upper and lower flanges 84, 86. The flange is a thinner extension of the flange 75. The flange 86 extends inwardly from a vertical flange 88 integral with and depending from the flange 75. The flange 84, 86 and 88 define recesses which snugly receive the lateral ends of the floor 20. The flange 76 is joined to the horizontal flange 75 by an outwardly curved flange section 89 which serves as a protective bumper bar. A similar bumper bar is formed by a curved lateral projection 90 of the flange 88.

Figure 5:
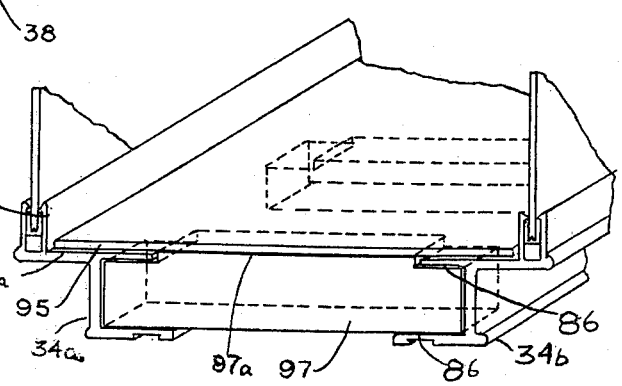
FIG. 5 is a fragmentary perspective view of an alternate floor for the container body.

Referring now to FIG. 5 there is illustrated an alternate to the floor 20 comprising a plurality of beams 97 located between the lower rails 34*a* and 34*b* whereby each of the beams 97 have ends which are stepped to fit between the flanges 84, 86 with the central portion of each beam 97*a* planar with the surface 84*a* of the flange 84. A floor 95 may then be placed between the inner flanges 78 of the rails 34*a* and 34*b*.

Moreover, if desired, the container may be assembled using two subassemblies each subassembly comprising a pair of panels joined together by a rail 30 i.e. the panels 16 and 18 and the rail 30. Each of the subassemblies may be assembled to each other by another rail 30 joined to the free ends of each subassembly thereby making a boxlike structure, the ends of which may be closed with end panels, in a manner identical to that illustrated in FIG. 4.

Figure 4:
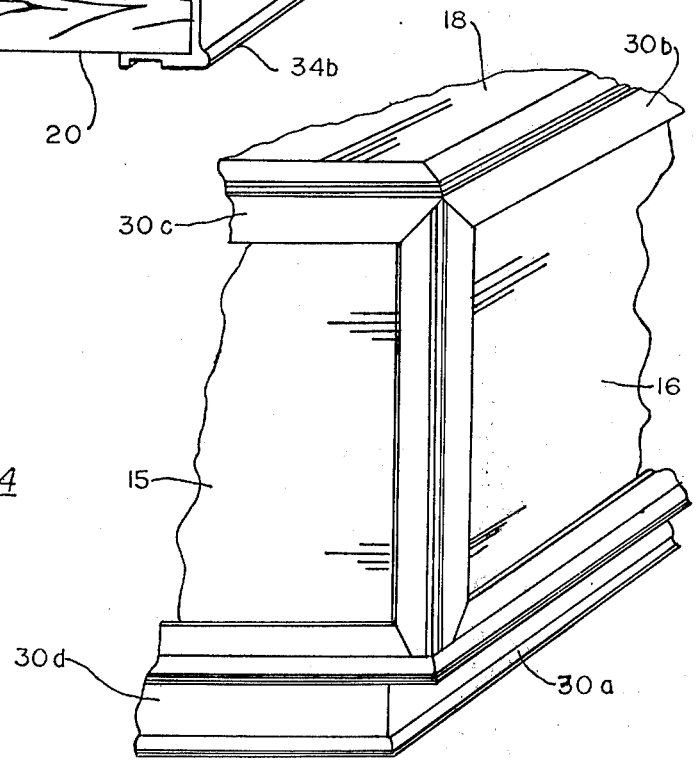
FIG. 4 is a fragmentary perspective view of a corner of the container body of FIG. 1 showing the junction of a side and front panel assembly.

The ends of the container are assembled in the identical fashion as the assembly of the sides 14 and 16 and the top 18 i.e. by using the molding 60 on each of the free edges and holding the moldings 60 in rails which are mitered at the corners, as illustrated in FIG. 4. The molding 60 (although not shown) is placed on a top end edge 92 (FIG. 3), a side panel end edge 91, a floor end edge 20*a* and all of the edges of a front end panel 15, in a similar fashion as hereinabove described in the assembly of the panels 14, 16 and 18. A top rail 30*c*, identical to the rails 30*a* and 30*b*, (previously described in detail) holds the channel moldings 60 from the panels 18 and 15 and a lower rail 34*c* is used to hold the channel moldings from the end panel 15 and the floor 20. In addition, a vertical rail 31 holds the moldings 60 from the panels 15 and 16, thereby completely sealing the container assembly. A rear end panel (not shown) may be assembled in the same manner as the front end panel 15, and may contain a door for access to the interior of the container, or in the alternative, the entire panel may function as a door by sliding between the flanges of the vertical rails 31.

The several moldings and rails may be manufactured at a relatively low cost. They can be made of many materials such as aluminum or fiberglass which may be extruded. The foregoing construction has the advantages of light weight, low cost, fast assembly, and kit construction. A further advantage is that all the panels are positively engaged at their edges for their entire lengths. There are no nuts and bolts to work loose. The assembly is permanent, secure and reliable.

It should be understood that the foregoing relates to only a preferred embodiment of the invention, and that it is intended to cover all changes and modifications of the example of the invention herein chosen for the purposes of the disclosure which do not constitute departure from the spirit and scope of the invention.

The invention claimed is:

1. An assembly for a container, comprising:

a first and second rectangular panel;

a U-shaped channel molding secured to each of two opposite edges of each panel, each of said moldings having spaced parallel side walls joined by an integral end wall, the inner sides of said side walls being formed with a plurality of teeth to bite into and securely engage opposite sides of one of said panels at each of said opposite edges; and a rail for engaging one of said edges from each of said first and second panels and holding said first and second panels in a mutual perpendicular array, said rails having two pairs of spaced flanges disposed in mutually perpendicular disposition, each pair of said spaced flanges defining a recess, one of said recesses for receiving one of said moldings from said first panel and the other of said recesses for receiving one of said moldings from said second panel, each pair of said flanges having inwardly extending opposing ledges arranged to engage the free edges of the received moldings so that said first and second panels are held in mutually perpendicular array.

2. An assembly for a container as defined in claim 1, wherein said ledges of said flanges have inwardly beveled edges to facilitate entry of said rails respectively between said flanges.

3. An assembly for a container as defined in claim 1 further comprising a sharp edged ridge integrally formed with said end wall of each of said moldings to bite into the edge of said panel inserted therein.

4. An assembly for a container as defined in claim 1, further comprising:

a third panel;

a pair of U-shaped other moldings each of which is secured to an opposite edge of said third panel, each of said other moldings having other spaced parallel side walls joined by an integral other end wall, inner sides of said other side walls being formed with teeth to bite into and securely engage the opposite sides of said third panel at said opposite edges; and a second rail engaging the free edge of said first panel and one of said edges of said third panel to form a rectangular U-shaped array including said first, second and third panels, said second rail having two pairs of spaced other flanges disposed in mutually perpendicular disposition each pair of said other spaced flanges defining other respective recesses, one of said other recesses for receiving the other of said moldings from said first panel and the other of said other recesses for receiving one of said moldings from said third panel, each pair of said other flanges having inwardly extending opposing other ledges arranged to engage the free edges of the received molding inserted thereinbetween, so that said second and third panels are held in spaced parallel positions.

5. An assembly for a container as defined in claim 4, further comprising:

a third and a fourth rail, each having one pair of spaced further flanges formed with inwardly extending opposing further ledges arranged to engage the free edges of the moldings mounted on the free edges of said second and said third panels.

6. An assembly for a container as defined in claim 5, further including a floor means located and supported on perpendicular flanges extending from said third and fourth rails.

7. An assembly for a container as defined in claim 5, wherein each of said third and said fourth rails has an additional pair of spaced flanges extending perpendicular to said further flanges to define further recesses for engaging edges of a floor panel.

8. An assembly for a container as defined in claim 7, wherein said ledges on all of said flanges have inwardly beveled edges to facilitate entry of said rails respectively between said flanges.

9. An assembly for a container as defined in claim 7, further comprising a sharp edged ridge integrally formed with said end wall each of said rails to bite into the edge of said panel inserted in said rail.

10. An assembly for a container as defined in claim 7, further comprising:

a fourth panel; and a pair of U-shaped still other moldings each of which is secured to an opposite edge of said fourth panel each of said still other moldings have still other spaced parallel side walls jointed by an integral still other end wall, inner sides of said still other side walls being formed with teeth to bite into and securely engage the opposite sides of said fourth panel at said opposite edges and wherein said moldings of said fourth panel are inserted in said spaced additional flanges in said and fourth rails thereby forming a boxlike structure.

* * * * *